US007357526B2

(12) United States Patent
Zeiler

(10) Patent No.: US 7,357,526 B2
(45) Date of Patent: Apr. 15, 2008

(54) POWER TOOL AND ACCESSORY

(75) Inventor: Jeffrey M. Zeiler, Pewaukee, WI (US)

(73) Assignee: Milwaukee Electric Tool Corporation, Brookfield, WI (US)

( * ) Notice: Subject to any disclaimer, the term of this patent is extended or adjusted under 35 U.S.C. 154(b) by 251 days.

(21) Appl. No.: 10/921,629

(22) Filed: Aug. 19, 2004

(65) Prior Publication Data

US 2005/0111214 A1 May 26, 2005

Related U.S. Application Data

(60) Provisional application No. 60/497,208, filed on Aug. 22, 2003.

(51) Int. Cl.
*F21V 33/00* (2006.01)

(52) U.S. Cl. ..... 362/119; 362/109; 362/120

(58) Field of Classification Search ..... 362/95, 362/109, 119, 120, 183, 198, 208, 253, 190
See application file for complete search history.

(56) References Cited

U.S. PATENT DOCUMENTS

| | | | | |
|---|---|---|---|---|
| 2,525,588 | A | | 10/1950 | Cameron et al. |
| 3,457,796 | A | | 7/1969 | Leach et al. |
| 3,977,278 | A | | 8/1976 | Jackson |
| 4,830,579 | A | * | 5/1989 | Cheng ..... 362/154 |
| 4,833,782 | A | | 5/1989 | Smith |
| 4,872,230 | A | | 10/1989 | Levine |
| 4,968,146 | A | | 11/1990 | Heizmann et al. |
| D327,827 | S | | 7/1992 | Kwan |
| 5,158,354 | A | | 10/1992 | Simonin |
| 5,169,225 | A | | 12/1992 | Palm |
| 5,427,002 | A | | 6/1995 | Edman |
| 5,445,479 | A | | 8/1995 | Hillinger |
| 5,473,519 | A | | 12/1995 | McCallops et al. |
| 5,541,822 | A | | 7/1996 | Bamber |
| D375,570 | S | | 11/1996 | Hayakawa et al. |
| 5,605,394 | A | | 2/1997 | Chen |
| D387,455 | S | | 12/1997 | Zurwelle |
| D388,201 | S | | 12/1997 | Zurwelle |
| D390,987 | S | | 2/1998 | Zurwelle |
| 5,720,542 | A | | 2/1998 | Birge, Jr. et al. |
| D392,759 | S | | 3/1998 | Howard et al. |
| 5,797,670 | A | | 8/1998 | Snoke et al. |
| D404,839 | S | | 1/1999 | Petterson et al. |
| D405,552 | S | | 2/1999 | Howard et al. |
| D410,293 | S | | 5/1999 | Prince |
| D413,994 | S | | 9/1999 | Clowers et al. |
| 5,954,458 | A | | 9/1999 | Lee |
| 5,959,306 | A | | 9/1999 | Kalley et al. |
| 5,983,443 | A | | 11/1999 | Redding |
| 5,988,828 | A | | 11/1999 | Prince et al. |
| D422,730 | S | | 4/2000 | Byler et al. |
| D427,346 | S | | 6/2000 | Schoen |
| D427,697 | S | | 7/2000 | Brazell et al. |
| D428,175 | S | | 7/2000 | Lynch et al. |
| 6,095,659 | A | | 8/2000 | Hsu |

(Continued)

*Primary Examiner*—Y. My Quach-Lee
(74) *Attorney, Agent, or Firm*—Michael Best & Friedrich LLP

(57) ABSTRACT

A power tool and accessory combination. The power tool has multiple terminals to which a battery pack or battery assembly can be connected. The accessory can be electrically connected to an unused tool terminal that is otherwise engageable by a battery pack.

40 Claims, 8 Drawing Sheets

U.S. PATENT DOCUMENTS

| | | | | |
|---|---|---|---|---|
| D438,316 | S | 2/2001 | Etter | |
| 6,206,538 | B1 | 3/2001 | Lemoine | |
| D444,582 | S | 7/2001 | Poon | |
| 6,301,997 | B1 | 10/2001 | Welte | |
| D451,222 | S | 11/2001 | Poon | |
| 6,315,425 | B1 * | 11/2001 | Confrey | 362/190 |
| 6,318,874 | B1 | 11/2001 | Matsunaga | |
| 6,332,891 | B1 | 12/2001 | Himes | |
| D454,040 | S | 3/2002 | Wadsworth | |
| 6,364,580 | B1 | 4/2002 | Dils et al. | |
| 6,454,453 | B1 | 9/2002 | Ambrosio | |
| 6,457,841 | B1 | 10/2002 | Lynch et al. | |
| D467,375 | S | 12/2002 | Lynch et al. | |
| 6,502,949 | B1 * | 1/2003 | Horiyama et al. | 362/119 |
| 6,575,590 | B1 | 6/2003 | Wadsworth | |
| D485,382 | S | 1/2004 | Palm | |
| 6,773,132 | B2 * | 8/2004 | Gilligan et al. | 362/119 |
| 2001/0029819 | A1 | 10/2001 | Okouchi | |
| 2002/0048166 | A1 | 4/2002 | Matsunaga | |
| 2002/0054491 | A1 | 5/2002 | Casas | |
| 2002/0054798 | A1 | 5/2002 | Dils et al. | |
| 2002/0057568 | A1 | 5/2002 | Sako et al. | |
| 2002/0058931 | A1 | 5/2002 | Parker et al. | |
| 2002/0067608 | A1 | 6/2002 | Kruse et al. | |
| 2002/0071289 | A1 | 6/2002 | Ambrosio | |
| 2002/0097572 | A1 | 7/2002 | Yeh | |
| 2002/0105796 | A1 | 8/2002 | Naghi et al. | |
| 2002/0105797 | A1 | 8/2002 | Navid et al. | |
| 2002/0110431 | A1 | 8/2002 | Dils et al. | |
| 2002/0125857 | A1 | 9/2002 | Mastaler et al. | |
| 2002/0131267 | A1 | 9/2002 | Van Osenbruggen | |
| 2002/0170185 | A1 | 11/2002 | Kondo et al. | |
| 2002/0172034 | A1 | 11/2002 | Lawless | |
| 2002/0172035 | A1 | 11/2002 | Hara et al. | |

* cited by examiner

POWER TOOL AND ACCESSORY

RELATED APPLICATIONS

This application claims priority under 35 U.S.C. § 119 to U.S. Provisional Application Ser. No. 60/497,208, filed Aug. 22, 2003.

FIELD OF THE INVENTION

This invention relates to power tools and power tool accessories and, more particularly, to electrical accessories for power tools.

BACKGROUND OF THE INVENTION

Typically, cordless power tools are powered by a removable, rechargeable battery. The battery may be coupled to a terminal assembly on a housing of the power tool.

Power tools are used for various primary operations including sawing and drilling. Additionally, secondary functions may be performed by an accessory of the power tool. For example, when primary operations are being performed, operators often desire additional illumination of the work area. Such additional illumination may be particularly desirable when working in dark or otherwise poorly-lit areas.

SUMMARY OF THE INVENTION

Currently, power tools are manufactured with a tool housing having multiple terminal assemblies. For example, a handle of a typical power tool housing may include multiple terminal assemblies, any one of which may be connected to a battery pack or battery assembly to provide electrical power to the power tool. With the battery pack connected to any one of the terminal assemblies, the other terminal assembly(ies) on the tool housing are left open and unused.

Conventional power tools may include accessories, e.g., a work light, vacuum, etc., that are coupled to a tool housing or to a battery pack that is connected to the tool housing. While these accessories may be usable with some existing power tools, these accessories may not be usable with the existing tool terminal assemblies which are engageable by a battery pack.

The present invention provides a power tool and accessory combination, which substantially alleviates one or more problems with existing power tools and accessories. The present invention provides a power tool that generally has multiple terminals or terminal assemblies to which a battery pack or battery assembly is removably connected. The present invention provides an accessory that is removably electrically connected to an unused tool terminal or terminal assembly that is otherwise engageable by a battery pack.

More particularly, in some aspects, the present invention provides a housing including a first tool terminal and a second tool terminal electrically communicating with the first tool terminal. The battery assembly is removably coupled to the housing and generally includes a battery terminal engaging one of the first tool terminal and the second tool terminal for electrical communication therewith. The tool accessory generally includes an accessory terminal engaging the other of the first tool terminal and the second tool terminal for electrical communication therewith.

The tool accessory may include a terminal portion and an operating portion, and the accessory terminal is provided on the terminal portion. The operating portion may include at least one of a light source, an electronic level, a vacuum, a fan, an electromagnet, a motor, a radio, another audio component, a heating element, a battery indicator or display (e.g., a fuel gauge, remaining time of operation, temperature, etc.), a tool operation indicator or display (e.g., speed, time of operation, etc.), a clock, a stud finder, a power supply for a cell phone or other separate electrical device, etc.

Also, in some aspects, the present invention provides a power tool generally comprising a housing including a main housing portion supporting the motor and a handle portion depending from the main housing portion. The housing also includes a first tool terminal and a second tool terminal, each tool terminal electrically communicating with the other tool terminal and with the electric motor. A battery assembly is removably coupled to the housing and generally includes a main body portion and a terminal portion, the terminal portion including a battery terminal that engages either of the first tool terminal and the second tool terminal for electrical communication therewith to provide electrical power to the electric motor and to the other of the first tool terminal and the second tool terminal. An accessory attachment generally includes an accessory terminal that engages the other of the first tool terminal and the second tool terminal and an operating portion, electrical power being transferred between the operating portion and at least one of the battery assembly and the electric motor.

In some aspects and in some constructions, the operating portion may operate in response to electrical power provided by the battery assembly. In some aspects and in some constructions, the operating portion may provide electrical power from the battery assembly to another electrical device. In some aspects and in some constructions, the operating portion may provide electrical power to the battery assembly.

The electrically-powered accessory may include at least one of a light source, an electronic level, a vacuum, a fan, an electromagnet, a motor, a radio, another audio component, a heating element, a battery indicator or display (e.g., a fuel gauge, remaining time of operation, temperature, etc.), a tool operation indicator or display (e.g., speed, time of operation, etc.), a clock, a stud finder, etc.

The power-transfer accessory may provide power from the battery to another electrical device, such as, for example, a cell phone. The power-transfer accessory may provide power to the battery (for example, to charge the battery) and/or to the electric motor of the power tool (for example, to power the electric motor during charging of the battery or in lieu of power supplied by the battery).

Further, in some aspects, the present invention provides a method for powering an accessory for a power tool, the accessory including an accessory terminal and an operating portion, the power tool including a first tool terminal, a second tool terminal, and a battery including a battery terminal. The method comprises the acts of selectively engaging the battery terminal with either of the first tool terminal and the second tool terminal to provide electrical power to the power tool and to the other of the first tool terminal and the second tool terminal, and engaging the accessory terminal with the other of the first tool terminal and the second tool terminal to transfer electrical power between the accessory and at least one of the battery and the power tool.

Additional independent features and independent advantages of the present invention will become apparent to those skilled in the art upon review of the following detailed description, claims and drawings.

Figure 1:
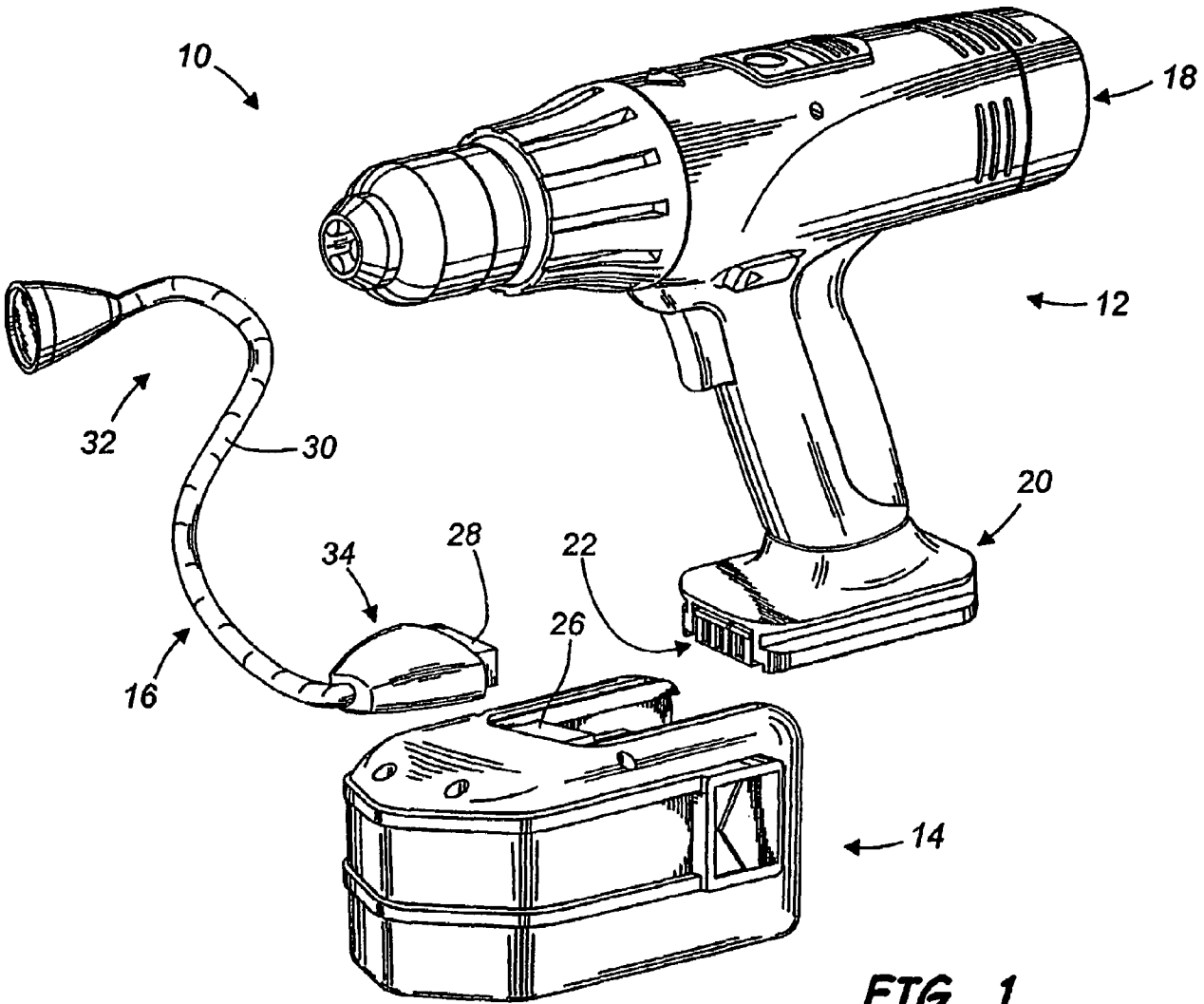
FIG. 1 is an exploded perspective view of a power tool embodying aspects of the invention, including a tool housing, a battery assembly, and an accessory in the form of a light.

Before any constructions or embodiments of the invention are explained in detail, it is to be understood that the invention is not limited in its application to the details of construction and the arrangements of components set forth in the following description or illustrated in the drawings. The invention is capable of other constructions and of being practiced or of being carried out in various ways. Also, it is to be understood that the phraseology and terminology used herein is for the purpose of description and should not be regarded as limiting.

DETAILED DESCRIPTION

Referring to FIG. 1, a power tool 10 according to aspects of the present invention, includes a tool housing 12, a battery assembly 14, and an accessory 16. The tool housing 12 can take on any of a multitude of power tool configurations, such as, for example, a drill, a hammer drill, a rotary hammer, a reciprocating saw, a circular saw, a miter saw, an impact wrench, a work light, etc. For example, as shown in the Figures, tool housing 12 is in the form of a drill. It should be understood that, in other constructions and for some aspects, the power tool 10 may be another type of electrical equipment, such as, for example, video equipment, audio equipment, lawn and garden equipment, a vacuum, a blower, etc.

Figure 2:
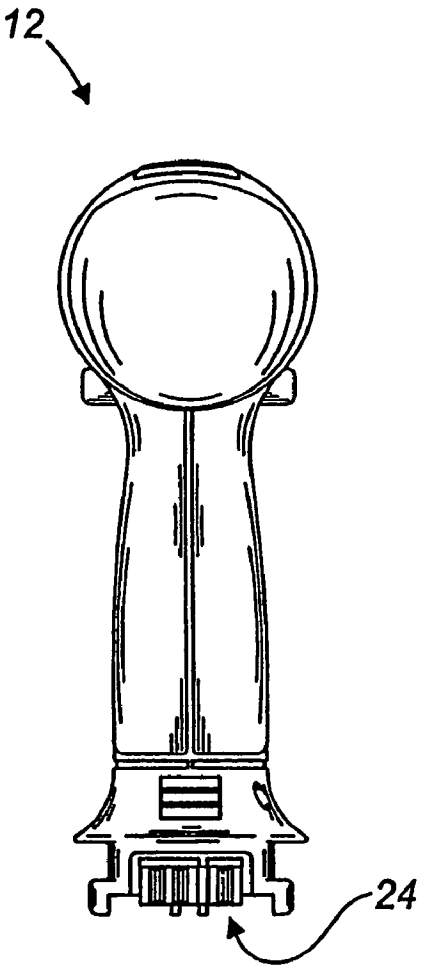
FIG. 2 is a rear view of the tool housing of FIG. 1.

The tool housing 12 includes a main housing portion 18 and a terminal portion 20. The terminal portion 20 includes a first tool terminal or terminal assembly 22 and a second tool terminal or terminal assembly 24 (see FIG. 2). The tool terminals 22 and 24 are oriented on substantially opposite sides of the terminal portion 20. However, it will be readily apparent that the orientation of the tool terminals 22 and 24 could vary. For example, the tool terminals could be positioned in other locations on the terminal portion 20 of the tool housing 12, or in entirely different locations on the tool housing 12. Further, there could be more than just the two tool terminals 22 and 24 shown in the Figures.

Figure 3:
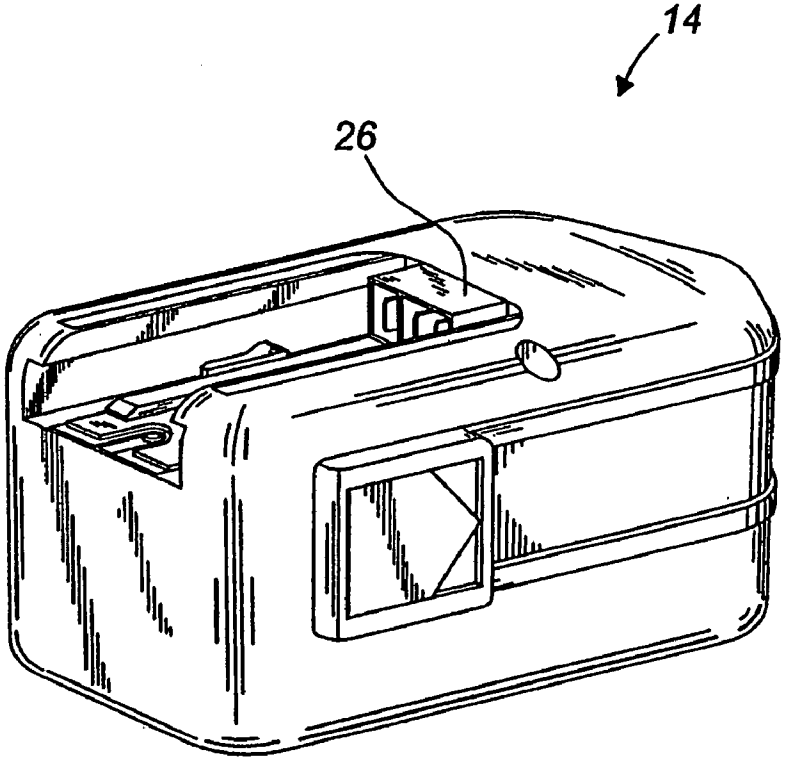
FIG. 3 is a rear perspective view of the battery assembly of FIG. 1.
Figure 4:
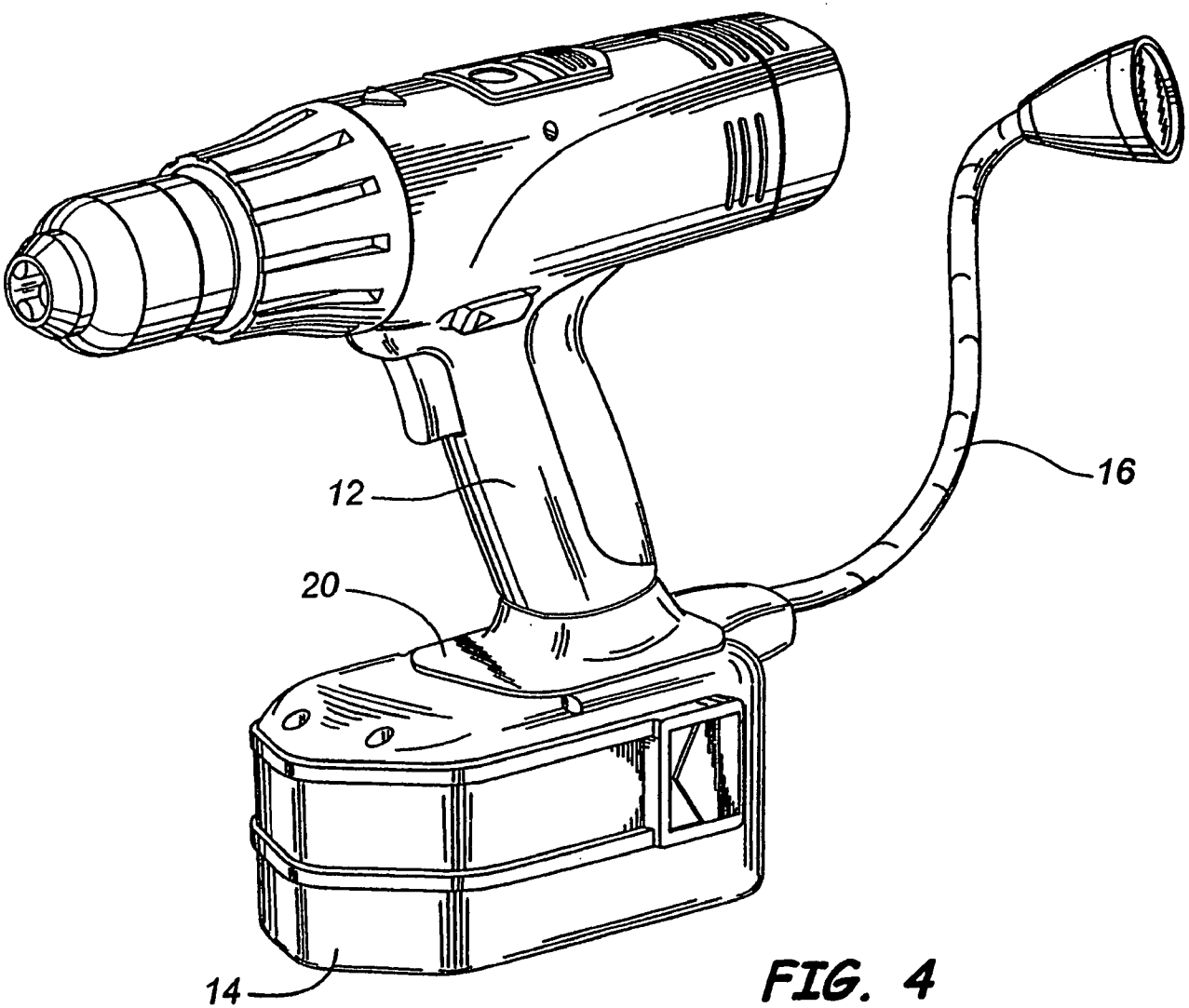
FIG. 4 is a perspective view of the battery assembly and light coupled to the tool housing in a first orientation.

The battery assembly 14 includes a battery terminal or terminal assembly 26 (best seen in FIG. 3) that is formed to mate with either of the tool terminals 22 and 24. In a first orientation, as shown in FIG. 4, the battery assembly 14 is coupled to the tool housing 12 so that the battery terminal 26 (hidden from view in FIG. 4) mates with the first tool terminal 22 (also hidden in FIG. 4) of the terminal portion 20 of the tool housing 12. In this configuration, electrical energy stored by the battery assembly 14 is supplied to the tool housing 12 through the connection between the battery terminal 26 and the first tool terminal 22 to power an electric motor (not shown) housed within the tool housing 12. At the same time, the second tool terminal 24 (also hidden in FIG. 4) is also powered through its electrical connection with the first tool terminal 22.

Figure 5:
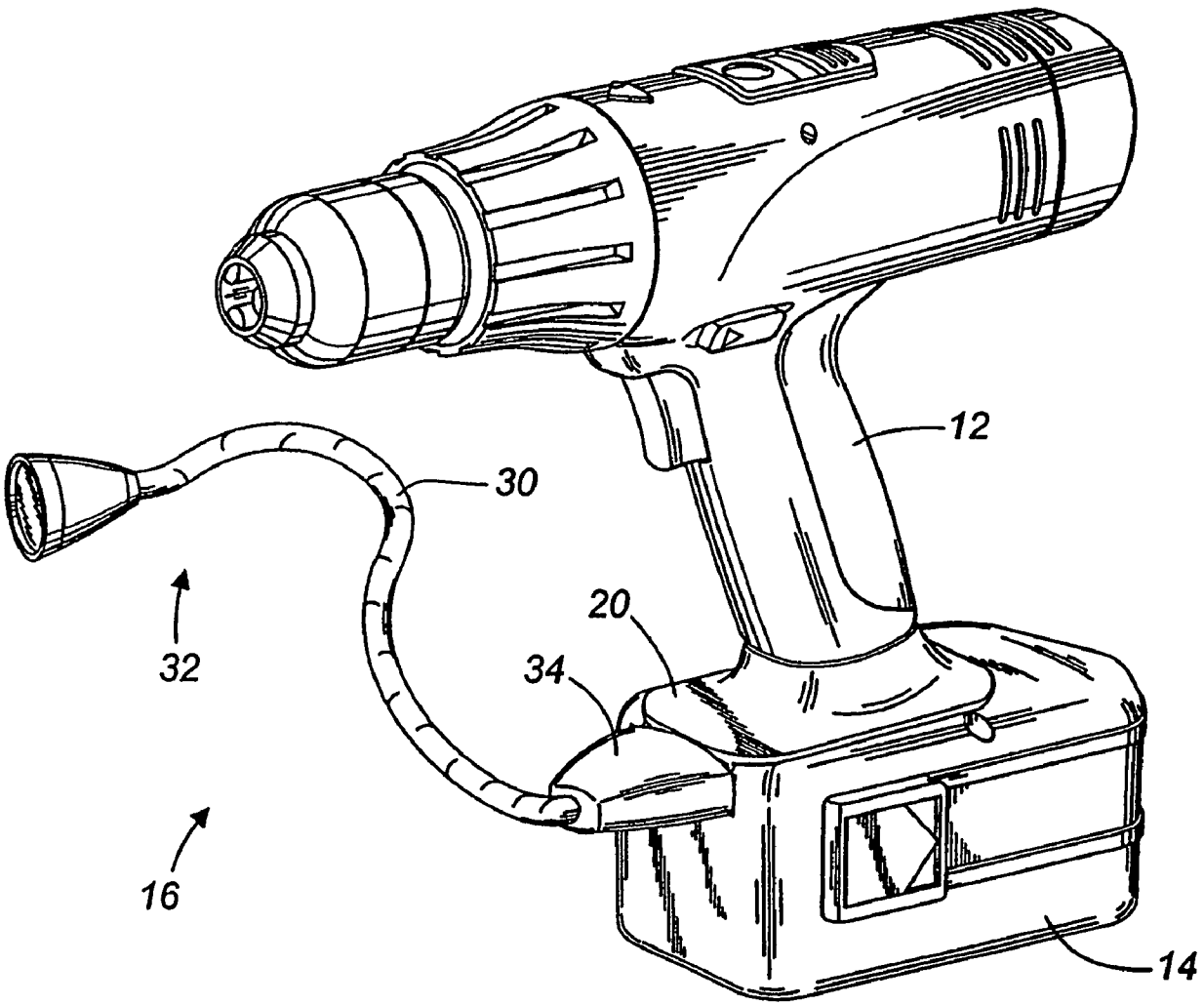
FIG. 5 is a perspective view of the battery assembly and light coupled to the tool housing in a second orientation.

Alternatively, the battery assembly 14 can be coupled to the terminal portion 20 of the tool housing 12 as shown in FIG. 5. In this orientation, the battery assembly 14 projects from the terminal portion 20 in a substantially rearward direction, with the battery terminal 26 (hidden from view in FIG. 5) mated with the second tool terminal 24 (also hidden in FIG. 5). In this way, electrical energy from the battery assembly 14 is connected through the battery terminal 26 and the second tool terminal 24 to the electric motor housed in the main housing portion 18 of the tool housing 12. Also, the first tool terminal 22 (also hidden in FIG. 5) is powered through its electrical connection with the second tool terminal 24.

With the battery assembly 14 coupled to the tool housing 12 through the second tool terminal 24 (as shown in FIG. 5), the first tool terminal 22 is available to be coupled to the accessory 16. Similarly, as mentioned above, with the battery assembly 14 coupled to the tool housing 12 through the first tool terminal 22 (as shown in FIG. 4), the second tool terminal 24 is available to be coupled to the accessory 16.

FIG. 5 illustrates the battery assembly 14 connected to the second tool terminal 24 and projecting substantially rearwardly from the terminal portion 20. The accessory 16 includes an operating portion 32 and a terminal portion 34. The terminal portion 34 includes an accessory terminal or terminal assembly 28 (see FIG. 1) connected to the first tool terminal 22 and extending substantially forwardly from the terminal portion 20 of the tool housing 12.

In the illustrated construction, friction between the tool terminal 22 or 24 and the accessory terminal 28 and/or engagement between the tool terminal portion 20 and the accessory terminal portion 34 provides the necessary support to retain the accessory 16 in position. In other constructions (not shown), an additional locking assembly (not shown) and/or an additional support assembly may be provided on the power tool 10, on the battery assembly 14, on the accessory 16 and/or on a combination of these components to retain the accessory 16 in position.

As shown in FIGS. 1 and 5, the accessory 16 is a light source, in this case including a flexible neck portion 30 as part of the operating portion 32 to allow the light source to be directed in various directions. However, in other constructions (not shown), the light may not include a flexible neck portion 30, and the operating portion may be supported by the battery assembly 14 and/or by the tool housing 12.

Figure 6A:
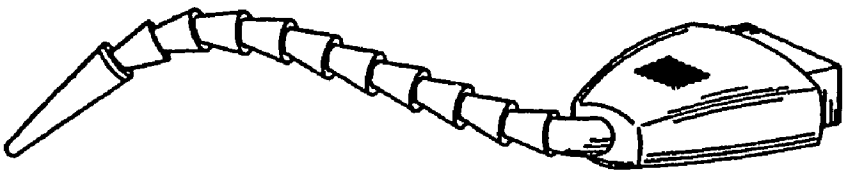
FIG. 6*a* is a perspective view of an accessory in the form of an air blower.
Figure 6B:
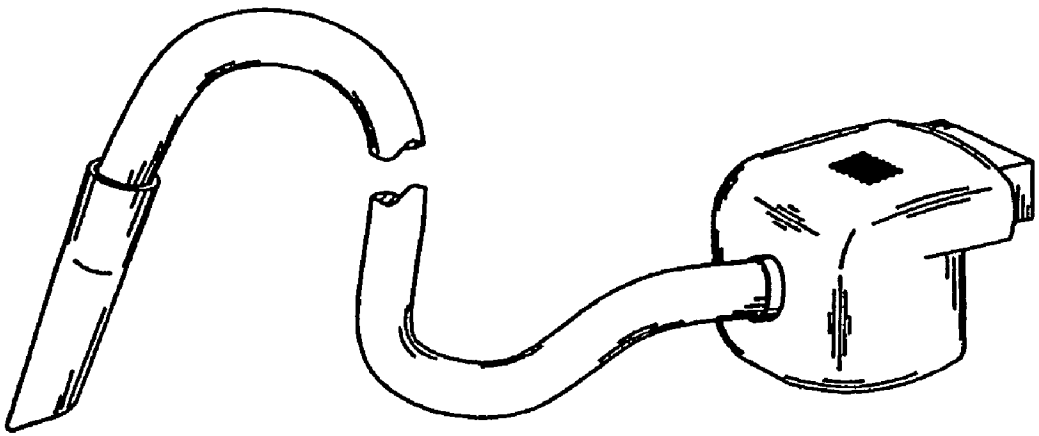
FIG. 6*b* is a perspective view of an accessory in the form of a vacuum.
Figure 6C:
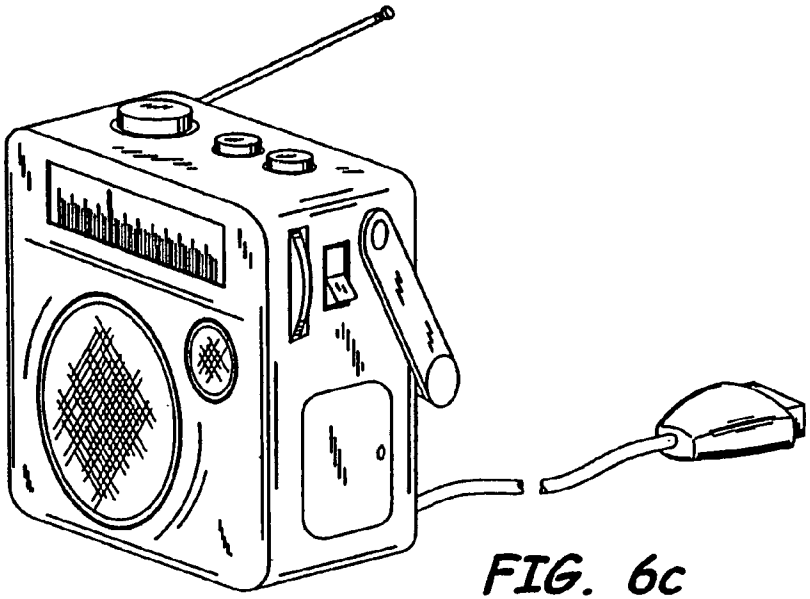
FIG. 6*c* is a perspective view of an accessory in the form of an audio component, such as a radio.
Figure 6D:
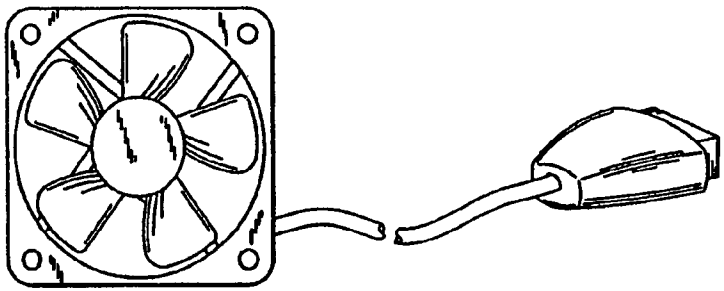
FIG. 6*d* is a perspective view of an accessory in the form of a fan.
Figure 6E:
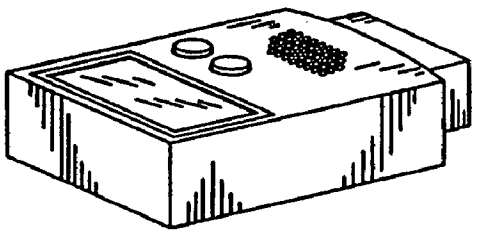
FIG. 6*e* is a perspective view of an accessory in the form of an electronic device.

Other accessories could be coupled to the first tool terminal 22 (or to the second tool terminal 24 if the battery assembly 14 is oriented as shown in FIG. 4) and receive power from the battery assembly 14. For example, the accessory could include an air blower (FIG. 6*a*); a vacuum (FIG. 6*b*); a radio (FIG. 6*c*); another audio component (not shown), such as, for example, an MP3 player, CD player, etc.; a video component (not shown); a fan (FIG. 6*d*); an electronic device (see FIG. 6*e*), such as a level, a battery indicator or display (e.g., a fuel gauge, remaining time of operation, temperature, etc.), a tool operation indicator or display (e.g., speed, time of operation, etc.), a clock, a stud finder, etc.; an electromagnet (not shown); a motor (not shown); a heating element (not shown); or any one of other various accessories for use with power tools or other electrical equipment.

Figure 6F:
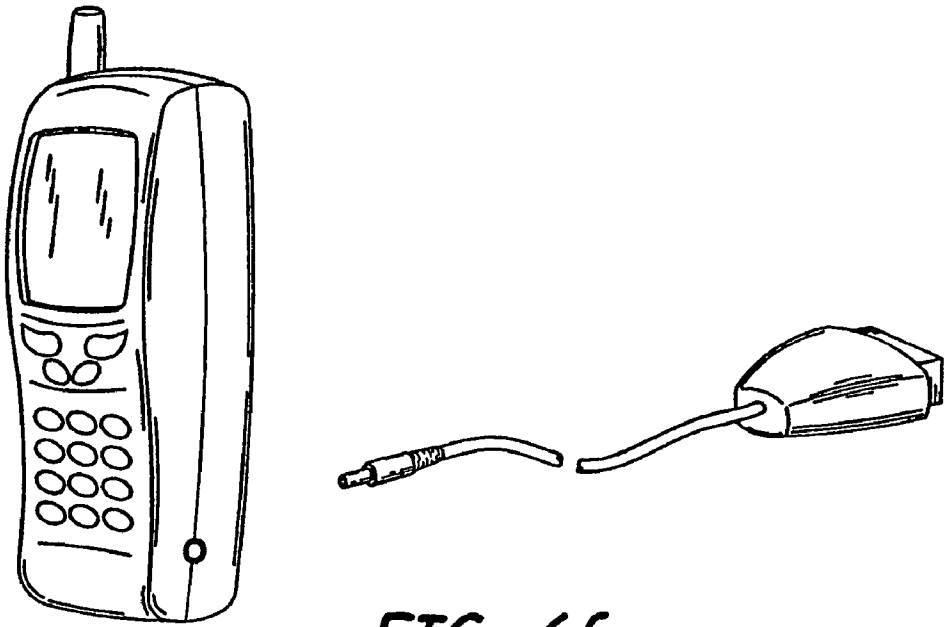
FIG. 6*f* is a perspective view of an accessory in the form of a power cord for supplying power from the battery assembly to another electrical device, such as a cell phone.

Still other accessories could be coupled to the first tool terminal 22 (or to the second tool terminal 24 if the battery assembly 14 is oriented as shown in FIG. 4) and receive power from the battery assembly 14. For example, the accessory could include a power cord (see FIG. 6*f*) for supplying power from the battery assembly 14 to another electrical device, such as a cell phone (as shown), an audio component (not shown), a video component (not shown), etc. Such an accessory includes a power output plug configured to electrically connect with the electrical device in a manner similar to the appropriate power cord for the electrical device. Such an accessory also includes the necessary circuitry and electronics (not shown) to supply power (having the characteristics required by the electrical device) from the battery assembly 14 to the electrical device.

Figure 6G:
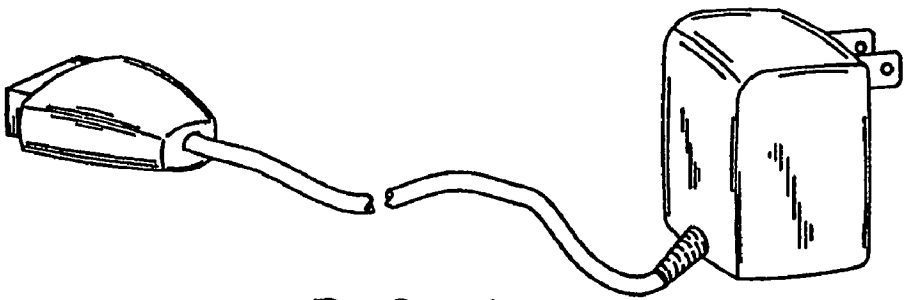
FIG. 6*g* is a perspective view of an accessory in the form of a power cord for supplying power to at least one of the battery assembly and the power tool.

Yet other accessories could be coupled to the first tool terminal 22 (or to the second tool terminal 24 if the battery assembly 14 is oriented as shown in FIG. 4) and transfer power through the tool terminal 22 or 24 to at least one of the battery assembly 14 and the motor of the power tool 10. For example, the accessory could include a power cord (see FIG. 6*g*) for supplying charging power to the battery assembly 14 and/or operating power to the motor of the power tool 10. Such an accessory includes a power input plug configured to electrically connect with the power source (not shown), such as, for example, AC line power. Such an accessory also includes the necessary circuitry and electronics (not shown but provided in the housing of the power source input plug) to supply power (having the characteristics required by the battery assembly 14 and/or the motor) from power source to the battery assembly 14 and/or to the motor of the power tool 10. In such constructions, circuitry and electronics may be provided in the power tool 10 and/or in the battery assembly 14 to selectively prevent the supply of power from the battery assembly 14 during any charging of the battery assembly 14 and/or during the supply of power from the other power source (not shown) to the power tool 10.

As mentioned above, in FIG. 5, the battery assembly 14 is connected to the second tool terminal 24 and extends rearwardly, while the accessory 16 is connected to the first tool terminal 22 and extends forwardly. However, if the battery assembly 14 is connected to the first tool terminal 22 and extends forwardly (as shown in FIG. 4), the accessory 16 can be connected to the second tool terminal 24, as discussed above. The type of accessory used, and the tool terminal to which the accessory 16 and the battery assembly 14 are coupled, can vary and can be chosen by the user of the power tool 10 based on the user's desired functionality.

Figure 7:
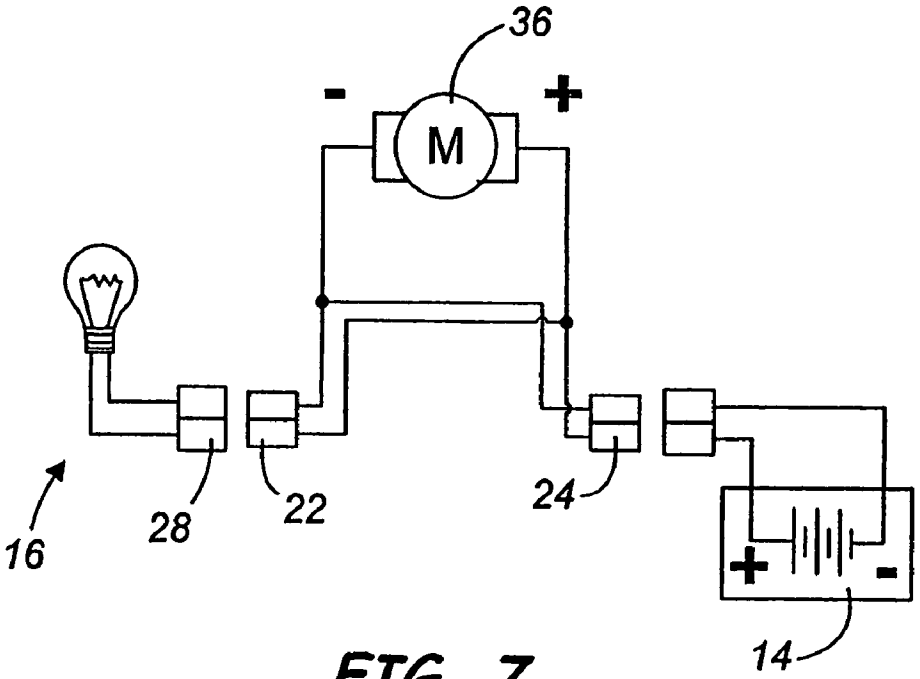
FIG. 7 is a circuit diagram showing portions of the wiring for the tool housing, the battery assembly, and the accessory of FIG. 1.

FIG. 7 illustrates the basic wiring configuration of the power tool 10. A motor 36 is wired to the tool terminals 22 and 24 and the two tool terminals 22, 24 are wired to each other so that when the battery assembly 14 is connected to one of the terminals 22 or 24, both the motor 36 and other terminal 22 or 24 are powered. In FIG. 7, the light accessory 16 is shown positioned to be connected to the first tool terminal 22, and the battery assembly 14 is positioned to be connected to the second tool terminal 24. This would result in a tool configuration as shown in FIG. 5. However, as discussed, the battery assembly 14 and light accessory 16 could be reversed, and the accessory could be any one of a number of contemplated accessories.

Also, as discussed above, a cord (see FIG. 6*g*) with an AC/DC adapter could be configured with a terminal on one end to connect to either of the tool terminals 22 or 24 and on the other end to plug into an alternative power source (e.g., a wall outlet, etc.). The cord would power the electric motor in the tool housing 12 through one of the tool terminals 22, 24. Additionally, the other of the tool terminals 22 or 24 may be powered and could thereby power an accessory or charge a battery assembly connected to the other of the tool terminals 22, 24.

The foregoing detailed description describes only a few of the many forms that the present invention can take and should, therefore, be taken as illustrative rather than limiting. It is only the claims, including all equivalents, that are intended to define the scope of the invention.

I claim:

1. A power tool comprising:

a housing including a first tool terminal and a second tool terminal electrically communicating with the first tool terminal, the first tool terminal being operable to selectively receive power and distribute power;

a motor supported by the housing;

a battery assembly removably coupled to the housing and including an integral battery terminal engaging one of the first tool terminal and the second tool terminal for electrical communication therewith; and a tool accessory including an accessory terminal engaging the other of the first tool terminal and the second tool terminal for electrical communication therewith.

2. The power tool of claim 1, wherein the housing includes a handle portion and a motor portion, and wherein the first tool terminal and the second tool terminal are provided on the handle portion.

3. The power tool of claim 1, wherein the first tool terminal and the second tool terminal are electrically coupled to the motor for providing electrical power from the battery assembly to the motor.

4. The power tool of claim 1, wherein the housing includes a main housing portion and a terminal portion that defines the first tool terminal and the second tool terminal, and wherein the main housing portion and the terminal portion are integral with one another.

5. The power tool of claim 1, wherein the tool accessory includes a terminal portion and an operating portion, and wherein the accessory terminal is provided on the terminal portion.

6. The power tool of claim 5, wherein the operating portion includes at least one of a light source, an electronic level, a vacuum, a fan, an electromagnet, a motor, a radio, and a heating element.

7. The power tool of claim 5, wherein the tool accessory further includes a flexible arm extending between the terminal portion and the operating portion.

8. The power tool of claim 5, wherein the operating portion is pivotally coupled to the terminal portion.

9. The power tool of claim 1, wherein the tool accessory includes an operating portion.

10. The power tool of claim 9, wherein the operating portion includes a light source.

11. The power tool of claim 10, wherein the operating portion includes a vacuum.

12. The power tool of claim 1, wherein the first tool terminal and the second tool terminal are substantially identical.

13. The power tool of claim 1, wherein the battery assembly provides electrical power to both the housing and the tool accessory.

14. A power tool comprising:

a housing including a main housing portion supporting a motor and a handle portion depending from the main housing portion, the housing also including a first tool terminal and a second tool terminal, each tool terminal electrically communicating with the other tool terminal and with the electric motor;

a battery assembly removably coupled to the housing and including a main body portion and an integral terminal portion, the integral terminal portion including a battery terminal engageable with either of the first tool terminal and the second tool terminal for electrical communication therewith to provide electrical power to the electric motor and to the other of the first tool terminal and the second tool terminal; and an accessory attachment including an accessory terminal engageable with the other of the first tool terminal and the second tool terminal, and an operating portion, electrical power being transferred between the accessory and at least one of the battery assembly and the motor.

15. The power tool of claim 14, wherein the operating portion operates in response to electrical power provided to the accessory attachment from the battery assembly.

16. The power tool of claim 15, wherein the operating portion includes at least one of a light source, an electronic level, a vacuum, a fan, an electromagnet, a motor, a radio, and a heating element.

17. The power tool of claim 14, wherein the operating portion includes a light source.

18. The power tool of claim 14, wherein the operating portion includes a vacuum.

19. The power tool of claim 14, wherein the first tool terminal and the second tool terminal are substantially identical to one another.

20. The power tool of claim 14, wherein the housing includes a terminal portion that defines the first tool terminal and the second tool terminal, and wherein the terminal portion is integral with at least one of the main housing portion and the handle portion.

21. The power tool of claim 14, wherein the accessory attachment further includes a flexible portion extending between the accessory terminal and the operating portion.

22. The power tool of claim 14, wherein the operating portion is pivotally coupled to the accessory terminal.

23. A method for operating an accessory and a power tool, the accessory including an accessory terminal and an operating portion, the power tool including a motor, a first tool terminal, a second tool terminal, and a battery including an integral battery terminal, the method comprising the acts of:

selectively engaging the battery terminal with either of the first tool terminal and the second tool terminal to provide electrical power to the motor of the power tool and to the other of the first tool terminal and the second tool terminal; and engaging the accessory terminal with the other of the first tool terminal and the second tool terminal to transfer electrical power between the accessory and at least one of the battery and the motor of the power tool.

24. The method of claim 23, wherein the first tool terminal and the second tool terminal are provided on a handle portion of the power tool, and wherein the selectively engaging act includes orienting the battery to extend from the handle portion in a first direction, and wherein the engaging act includes orienting the accessory to extend from the handle portion in a second direction that is substantially opposite the first direction.

25. The method of claim 23, wherein the selectively engaging act includes moving the battery in a first direction with respect to the power tool, and wherein the engaging act includes moving the accessory in a second direction substantially opposite the first direction with respect to the power tool.

26. The method of claim 23, wherein the operating portion includes a light source, and wherein the method further comprises the act of lighting a work piece with the light source.

27. The method of claim 23, wherein the operating portion includes a vacuum, and wherein the method further comprises the act of removing debris from a work piece with the vacuum.

28. A power tool comprising:

a housing including a first tool terminal and a second tool terminal electrically communicating with the first tool terminal;

a motor supported by the housing;

a tool accessory including an accessory terminal engageable with either of the first tool terminal and the second tool terminal for electrical communication therewith; and a power source removably coupled to the housing and including an integral power source terminal engaging with one of the first tool terminal and the second tool terminal for electrical communication therewith.

29. The power tool of claim 28, wherein the first tool terminal and the second tool terminal are electrically coupled to the motor for providing electrical power from the power source to the motor.

30. The power tool of claim 28, wherein the housing includes a main housing portion and a terminal portion that defines the first tool terminal and the second tool terminal, and wherein the main housing portion and the terminal portion are integral with one another.

31. The power tool of claim 28, wherein the power source includes a battery assembly removably coupled to the housing and including a main body portion and a terminal portion, the terminal portion including a battery terminal engageable with either of the first tool terminal and the second tool terminal for electrical communication therewith to provide electrical power to the electric motor and to the other of the first tool terminal and the second tool terminal.

32. The power tool of claim 28, wherein the tool accessory includes an operating portion.

33. The power tool of claim 32, wherein the operating portion includes a light source.

34. The power tool of claim 32, wherein the operating portion includes a vacuum.

35. An accessory for a power tool, the power tool including a motor, a first tool terminal, a second tool terminal, and a battery including an integral battery terminal, the integral battery terminal being engageable with either of the first tool terminal and the second tool terminal and being operable to supply power to the motor of the power tool and to the other of the first tool terminal and the second tool terminal, the accessory comprising:

an accessory terminal engageable with the other of the first tool terminal and the second tool terminal; and an operating portion, electrical power being transferred between the accessory and at least one of the battery and the power tool.

36. The accessory of claim 35, wherein the operating portion includes at least one of a light source, an electronic level, a vacuum, a fan, an electromagnet, a motor, a radio, and a heating element.

37. The accessory of claim 35, wherein the operating portion includes a light source.

38. The accessory of claim 35, wherein the operating portion includes a vacuum.

39. The accessory of claim 35, and further comprising a flexible portion extending between the accessory terminal and the operating portion.

40. The accessory of claim 35, wherein the operating portion is pivotally coupled to the accessory terminal.

* * * * *